US005746323A

United States Patent [19]

Dragotta

[11] Patent Number: 5,746,323

[45] Date of Patent: May 5, 1998

[54] APPARATUS FOR HIGH SPEED INSPECTION OF OBJECTS

[75] Inventor: Peter J. Dragotta, Wayne, N.J.

[73] Assignee: M.W. Technologies, Inc., Elmwood Park, N.J.

[21] Appl. No.: 570,402

[22] Filed: Dec. 11, 1995

[51] Int. Cl.[6] ..... B07C 5/02

[52] U.S. Cl. ..... 209/539; 209/577; 209/540; 209/644; 209/657; 209/905; 209/919; 209/923; 209/939

[58] Field of Search ..... 209/939, 923, 209/539, 540, 559, 576, 577, 644, 657, 905, 919; 198/392, 443

[56] References Cited

U.S. PATENT DOCUMENTS

| | | | |
|---|---|---|---|
| 3,706,368 | 12/1972 | Sterling | 198/392 |
| 4,757,382 | 7/1988 | Kaziura et al. . | |
| 4,921,106 | 5/1990 | Spatafora et al. | 209/539 |
| 5,044,487 | 9/1991 | Spatafora et al. | 198/392 |
| 5,058,749 | 10/1991 | Jong | 209/539 |
| 5,135,113 | 8/1992 | Mayer et al. | 209/657 X |
| 5,240,118 | 8/1993 | Mayer | 209/919 |
| 5,311,999 | 5/1994 | Malow et al. | 209/939 X |
| 5,423,431 | 6/1995 | Westin | 209/539 |
| 5,549,189 | 8/1996 | Martisala | 198/392 X |

*Primary Examiner*—David H. Bollinger
*Attorney, Agent, or Firm*—Anthony J. Casella; Gerald E. Hespos; Ludomir A. Budzyn

[57] ABSTRACT

A conveying system for tablet inspection is provided. The conveying system includes a hopper assembly for feeding tablets to a conveyor at a controlled rate. The conveyor includes a pair of conveyor belts surrounding a plenum that communicates with a vacuum pump. The conveyor belts are parallel to one another and are spaced a distance for efficiently supporting a tablet thereon. An uprighter is disposed between the hopper assembly and the conveyor to rotate the tablets into an upright condition supported on an edge. The tablets are stably held in the upright position by the vacuum pump and are moved rapidly in their upright condition by the rotatably driven conveyor belts. The upright orientation of the tablets permits the opposed sides of each tablet to be electro-optically inspected for defects without repositioning the tablets and without changing the direction of movement.

23 Claims, 2 Drawing Sheets

APPARATUS FOR HIGH SPEED INSPECTION OF OBJECTS

BACKGROUND OF THE INVENTION

1. Field of the Invention

The subject invention relates to an apparatus for rapidly delivering medicinal tablets to electro-optical inspection stations and ejecting tablets with optically identifiable defects.

2. Description of the Prior Art

Medications in tablet form are manufactured in very large quantities by automated machinery and may be temporarily stored in bulk prior to final packaging. Some tablets may be formed improperly or may be damaged as they are being fed into or out of bulk storage. A damaged tablet can affect the dosage of medication being delivered to a patient, and the visual appearance of a damaged tablet reflects poorly upon quality control standards of the pharmaceutical company. In certain situations, an entirely different medication made at the same pharmaceutical facility could inadvertently be mixed with the supply of tablets being packaged. This "foreign" tablet could create a product liability risk. As a result, pharmaceutical companies require optical inspection of each tablet prior to final packaging.

Similar inspection needs exist in other industries. For example, manufacturers of small hardware items, eyelets, buttons and ammunition primers undertake inspection prior to packaging. The remaining discussions relate primarily to medicinal tablets. However, it is to be understood that both the prior art and the inventive technology described below have applications in other industries.

The extremely rapid rate at which tablets can be manufactured and packaged by available automated equipment makes inspection by an unaided human eye impractical and unjustifiably costly. On the other hand, electro-optical equipment, such as video cameras, are available for quickly and accurately identifying defects in tablets. A prior art electro-optical scanner can be positioned near a conveyor carrying a linear array of tablets for sequentially inspecting tablets moving on the conveyor. The prior art electro-optical scanner generates electrical signals corresponding to optical images. The scanner is operatively connected to a processor that compares the signals to parameters corresponding to an acceptable tablet or to an unacceptable tablet. The processor generates a defect signal when a defective tablet has been identified. An eject mechanism may be mounted in proximity to the conveyor and may be operably connected to the processor. The eject apparatus may be triggered in response to the defect signal generated by the processor to quickly eject the defective pill or tablet from the conveyor. The ejected tablet may be received in or transported to a reservoir for subsequent discard or reprocessing. Tablets that are not ejected may be transported to appropriate packaging equipment.

A prior art apparatus as described above is shown in U.S. Pat. No. 4,757,382 to Kaziura et al. The apparatus shown in U.S. Pat. No. 4,757,382 includes an aligning mechanism which orients tablets into a linear array with each tablet lying on one of its two opposed large surface areas. The apparatus further includes a first pair of rotating discs that are spaced from one another by a distance less than the major cross-sectional dimension of the large surface area of the tablets being inspected. A portion of the space between the first pair of discs communicates with a first vacuum. Tablets to be inspected are delivered from the aligning mechanism onto peripheral regions on the first pair of rotating discs such that a first side of each tablet faces away from the discs and such that a second side of each tablet is held in place on the discs by the first vacuum. The first pair of discs then move each tablet through an arc past a first electro-optical scanner that inspects the first side of each tablet and identifies defects therein.

The apparatus shown in U.S. Pat. No. 4,757,382 also includes a second pair of rotating discs, a second electro-optical scanner and a second vacuum communicating with a portion of the space between the second pair of discs. The second pair of rotating discs is slightly spaced from the first pair of rotating discs such that a narrow nip, approximately the thickness of a tablet, exists between the respective pairs of rotating discs. Additionally, the vacuums are arranged such that the first vacuum stops holding the tablets at the nip and that the second vacuum begins holding the tablets at the nip. The second pair of discs rotates in a direction opposite the first pair of rotating discs. With this arrangement, tablets on the first pair of rotating discs are delivered into the nip after the first electro-optical scanner completes its inspection of the first side on each tablet. The inspected first side of each tablet is then brought into contact with peripheral regions of the second pair of rotating discs as each tablet enters the nip between the oppositely rotating pairs of discs. This previously inspected first side of each tablet is then held by the vacuum between the second pair or rotating discs to sequentially remove each tablet from the first pair of rotating discs. The second pair of rotating discs then causes the second side of each tablet to move past the second electro-optical scanner to complete the inspection of each tablet.

The apparatus shown in U.S. Pat. No. 4,757,382 inherently imposes mechanical complications and operating speed limitations. For example, centrifugal force could cause tablets to separate from the disks at high rotational speeds. Additionally, the need to change direction of movement of the tablets imposes limitations on the speed at which the apparatus can operate. The speed and location of the respective moving parts must be carefully coordinated and controlled relative to one another and relative to the vacuum. This necessarily complicates the entire apparatus and increases the cost. The vacuum forces in the structurally and functionally separate pairs of rotating discs also must be carefully controlled relative to one another to ensure that the transfer from the first pair of rotating discs to the second pair is carried out properly. Additionally, the nip between the pairs of rotating discs must closely match the dimensions of the tablets being inspected. Structural components of the apparatus must be carefully readjusted to permit inspection of a second batch of tablets that are dimensioned differently from a first batch.

In view of the above, it is an object of the subject invention to provide a simpler, faster and less expensive apparatus for delivering tablets to an electro-optical inspector.

SUMMARY OF THE INVENTION

The subject invention is directed to an apparatus for delivering a linear array of objects, such as medicinal tablets, at high speed for efficient electro-optical inspection. The apparatus includes a hopper for storing the objects and a feeder assembly for delivering objects from the hopper. The feeder assembly may include inner and outer centrifugal feeders disposed generally concentrical with one another and rotatably driven about a common axis. The inner feeder may be configured to deliver object to the outer feeder, and the outer feeder may be configured to deliver objects sequentially to downstream locations. The delivery of objects is achieved by centrifugal force attributable to the rotation of the respective feeders. The outer feeder is operative to rotate faster than the inner feeder, with the respective rotational speeds being independently adjustable. Thus, excessive bunching of objects in proximity to the outlet from the outer feeder can be prevented and controlled by the slower feed of objects into the outer feeder from the inner feeder.

The apparatus may further include a rotational guide member in the form of a fixed finger at the outlet from the feeder assembly for rotating or flipping each object 90°. Thus, each object may be supported in an upright relationship on a narrow edge. The respective first and second large area sides of each object will be oriented to permit simultaneous or sequential electro-optical inspection without repositioning the objects and without changing their direction of movement.

The exit of objects from the feeder assembly may further be controlled by pinch belts for driving objects from the feeder at a precisely controlled and predictable rate determined by the speed of movement of the pinch belts. The spacing between the pinch belts is selected to accommodate objects in the preferred rotational orientations as they are being fed from the feeder assembly.

The apparatus further includes a conveyor belt arranged to have a plurality of linear sections. The belt is formed from a material that is permeable to air flow. For example the belt may be a perforated metal foil, a fabric or a foamed material that may be molded or machined to a desired cross-section. At least one linear section of the belt may overlie a vacuum source. The belt functions to transport objects substantially linearly, and the vacuum source functions to hold the objects on the linearly moving section of the belt. The combination of the vacuum source and the moving belt may be disposed in proximity to the pinch belts for receiving objects delivered at a metered rate from the pinch belts.

The apparatus further includes electro-optical scanners, such as video camera systems, for inspecting each object for defects. The electro-optical scanners can be directly opposite one another or offset to sequentially inspect one side area then the opposed side area of each object. Video images from the cameras or other such scanners are converted into electrical signals. The electrical signals from the cameras are transmitted to a processor which generates a defect signal in response to electrical signals corresponding to any of several specified defects. The defect signal in turn is delivered to an eject apparatus for ejecting objects with defects into a reject hopper for discard or reprocessing.

DETAILED DESCRIPTION OF THE PREFERRED EMBODIMENT

Figure 1:
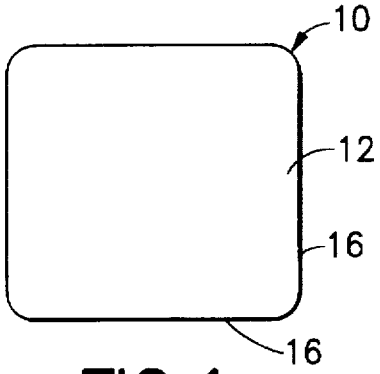
FIG.1 PRIOR ART
FIG. 1 is a side elevational view of a prior art medicinal tablet that can be inspected with the apparatus of the subject invention, with the opposed side elevational view being substantially identical.
Figure 2:
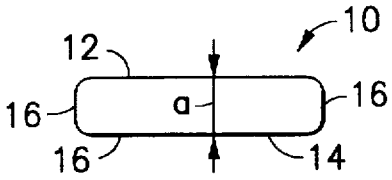
FIG.2 PRIOR ART
FIG. 2 is a elevational view of the prior art medicinal tablet shown in FIG. 1.
Figure 3:
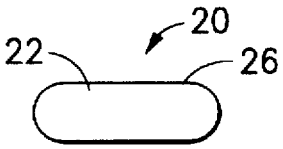
FIG.3 PRIOR ART
FIG. 3 is a side elevational view of another prior art tablet.
Figure 4:
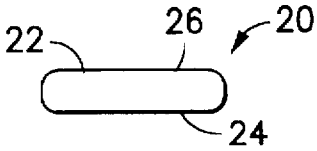
FIG.4 PRIOR ART
FIG. 4 is an elevational view of an edge of the tablet shown in FIG. 3.

A prior art medicinal tablet is identified generally by the numeral 10 in FIGS. 1 and 2. The prior art tablet 10 includes opposed first and second side surfaces 12 and 14 of substantially identical polygonal shape and a plurality of edge surfaces 16 extending between the side surfaces 12 and 14. The tablets 10 define a thickness "a" as shown in FIG. 2. The first and second side surfaces 12 and 14 are illustrated as being squares. However, other polygonal shapes may be provided and the respective sides need not be equal. Additionally, the first and second side surfaces 12 and 14 and the edge surfaces 16 are not purely planar and exhibit a slight rounding, particularly at the edges to facilitate ingestion. FIGS. 3 and 4 show a non-polygonal prior art tablet 20 having first and second side surfaces 22 and 24 of generally oval or oblong shape and edge surfaces 26 extending therebetween. In both the prior art tablet 10 and the prior art tablet 20, the side surfaces 12, 14, 22 and 24 represent large cross-sectional areas compared to the edge surfaces 16 and 26. The prior art tablets 10 will be referred to further herein for use with the apparatus of the subject invention. However, it is to be understood that objects of any other shape may be employed with the subject invention.

Figure 5:
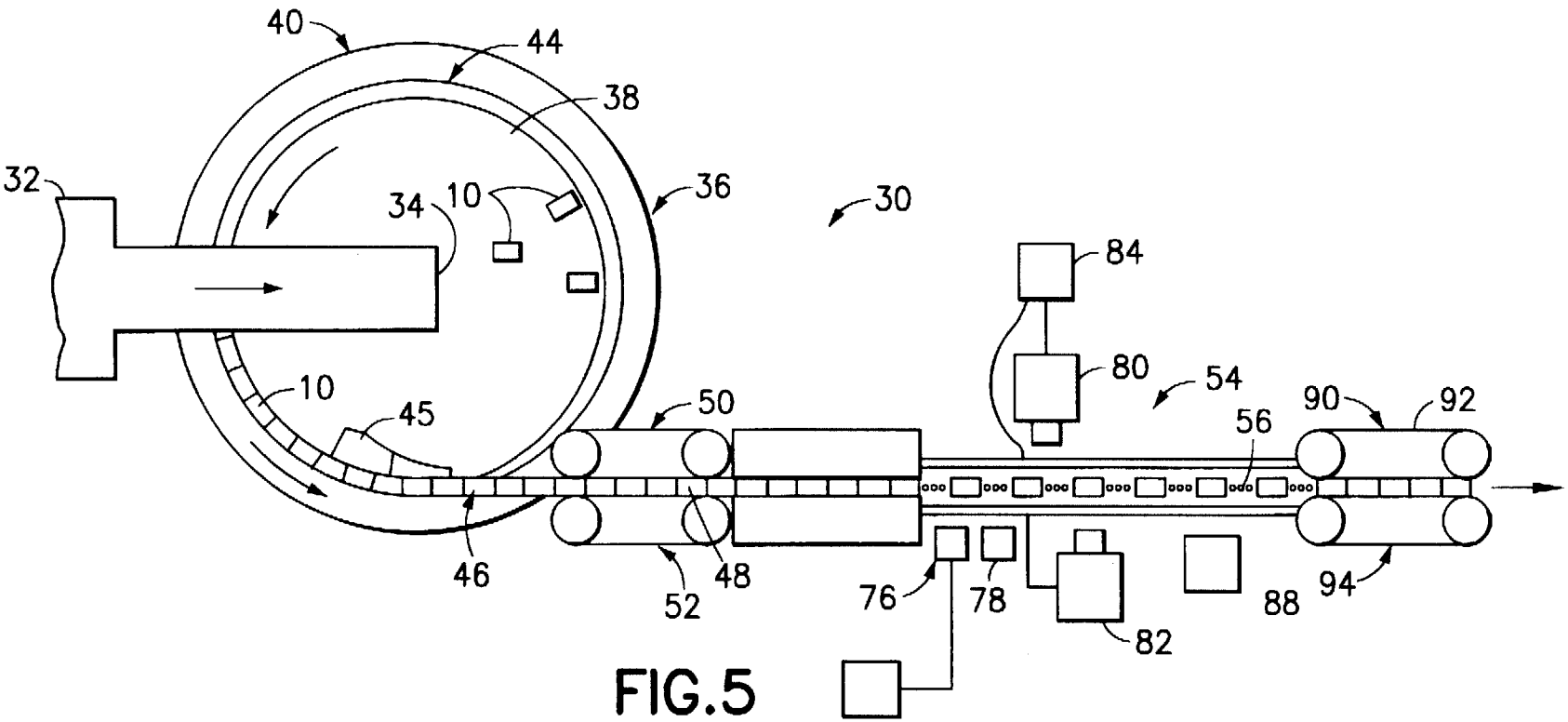
FIG. 5 is a schematic top plan view of an apparatus in accordance with the subject invention.

The prior art tablets 10 are inspected by the apparatus of the subject invention which is identified generally by the numeral 30 in FIG. 5. More particularly, a large number of prior art tablets 10 are stored in a bin 32 which periodically or continuously may be replenished with additional tablets 10. The bin 32 includes an outlet 34 which communicates with a rotatable feeder assembly 36. The feeder assembly 36 includes concentrically arranged inner and outer feeders 38 and 40 each of which rotates about an axis. A fixed rail 44 is mounted concentrically about a portion of outer feeder 40. Tablets 10 are moved radially outwardly by centrifugal force generated by the rotation of the inner and outer feeders 38 and 40. The fixed rail 44 stops the radially outward movement of the tablets 10 and hence causes the tablets 10 to move circumferentially on the outer feeder 40 adjacent the fixed rail 44. An uprighter 45 is disposed radially inwardly of the fixed rail 44. The uprighter 45 is twisted along its length and functions to rotate each tablet 10 from its stable orientation on a side surface 12 or 14 onto an edge 16. Although the narrow edges 16 are unstable supports, centrifugal force holds the tablets 10 in this upright orientation against the rail 44.

The fixed rail 44 includes an outlet 46 circumferentially down stream from the uprighter 45. The outlet 46 is dimensioned to accommodate tablets 10 in their upright orientation.

The inner feeder 38 is driven to rotate at a slower rotational speed than the outer feeder 40. Thus, a lower centrifugal force is imposed upon the tablets 10 in the inner feeder 38, and the tablets 10 exit at a slower rate from the inner feeder 38 than from the outer feeder 40. In this manner, the number of tablets 10 in the outer feeder 40 can be limited and controlled to an amount that can be accommodated efficiently by the outlet 46 from the outer feeder 40 without jamming or overflow. The different rotational speeds preferably are achieved with separate motors for the inner and outer feeders 38 and 40, with at least one motor being variable so that the differential between the rotational speeds of the inner and outer feeders 38 and 40 can be adjusted and fine tuned.

The apparatus 30 further includes a chute 48 for receiving tablets 10 ejected from the outlet 46. A pair of oppositely rotating pinch belts 50 and 52 are at an end of the chute 48 remote from the feeder assembly 36. The pinch belts 50 and 52 are spaced apart a selected distance for receiving the tablets 10, and urging the tablets 10 away from the feeder assembly 36. The oppositely rotating pinch belts 50 and 52 perform the dual function of a metering valve for developing a controlled rate of linear movement of the tablets 10 while simultaneously imparting to the respective tablets 10 sufficient linear speed for movement onto portions of the apparatus 10 at which inspection is carried out.

The apparatus 30 further includes a conveying system 54 for conveying tablets ejected from the pinch belts 50 and 52. The preferred conveying system includes a perforated metal conveyor belt 56 which defines a complete loop. Other air permeable materials may be used for the conveyor belt 56, including a fabric belt and/or a formed belt. Additionally the conveyor belt may include at least one timing belt that is molded or machined to accommodate tablets 10 at a desired spacing. The conveyor belt 56 is rotatably mounted to drives 60 and 62 such that the conveyor belt 56 defines a planar upper support surface 64 which is continuously driven by the drive 60 and 62 in the direction indicated by the arrows in FIG. 6. The upper support surface 64 is disposed to receive prior art tablets 10 ejected from the pinch belts 50 and 52.

The conveying station 54 further includes a plenum chamber 72 between the upstream and downstream drives 60 and 62, and beneath the upper support surface 64. The plenum 72 is in communication with a vacuum pump which is illustrated schematically and identified generally by the numeral 74. The suction in the plenum chamber 72 acts through perforations in the conveyor belt 56, and securely stabilizes the otherwise unstable tablets 10 in an upright condition on the narrow width edge surfaces 16.

Figure 6:
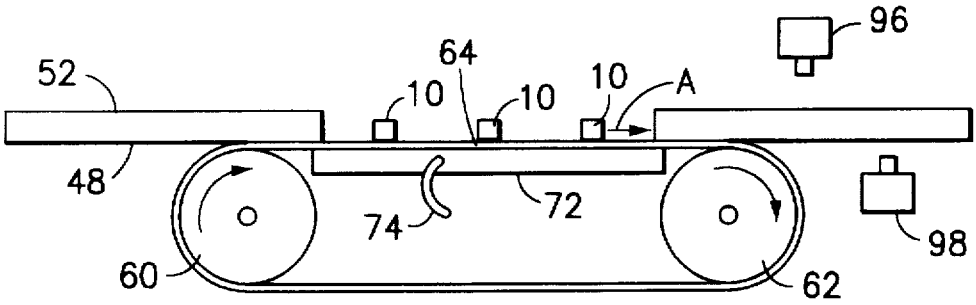
FIG. 6 is a side elevational view of the conveyor of the subject apparatus.
Figure 7:
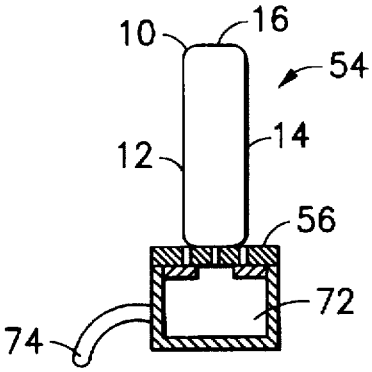
FIG. 7 is a cross-sectional view taken along line 7—7 in FIG. 6.

The tablets 10 are transported in the direction indicated by the arrow "A" in FIG. 6 with the side surfaces 12 and 14 being readily optically observable from the opposed sides of the conveying station 54. An electro-optical scanner 76 is disposed adjacent the upstream end of the conveying station 54 and is operative to sense the spacing or time between adjacent tablets 10. Spacings or elapsed times that are too small may yield improper readings downstream. More particularly, too small a distance may correspond to insufficient time for the vision system described below to process an image. As a result, a blow-off unit 78 is provided adjacent the conveying station 54 and downstream of the scanner 76. The blow-off unit 78 is operative to eject at least one tablet 10 if a spacing that is too small is detected by the scanner 76.

Video cameras 80 and 82 are disposed on opposite respective sides of the conveying station 54 downstream from the spacing scanner 76 and blow-off unit 78 as shown most clearly in FIG. 5. The cameras 80 and 82 may be of a type used in prior art inspection systems and communicate with a processor 84 to identify defects in either side surface 12 or 14 of the tablets 10. The upright orientation of the tablets 10 in the conveying station 54 permits both side surfaces 12 and 14 to be inspected without a repositioning of the tablet as had been the case in the prior art. Additionally, the tablets 10 can be moved entirely linearly during inspection. Thus, the tablets may be moved at a fast speed past the cameras 80 and 82. Additionally, since repositioning of the tablets 10 is not required, the apparatus 30, and in particular the conveying station 54, can be much simpler, less costly and more reliable than prior art systems. As depicted in FIG. 5, the cameras 80 and 82 are longitudinally offset from one another. However, it is envisioned that in certain embodiments the cameras 80 and 82 may be aligned with one another.

The apparatus 30 further includes an ejector 86 in proximity to the conveying station 54 and downstream from the cameras 80 and 82. The ejector is electrically connected to the processor 84 and is triggered in response to a defect identified by either camera 80 or 82. The ejector functions to eject tablets 10 that have been identified as having a defect. The ejected tablets 10 are merely urged into a reject bucket 88. The rejected tablets 10 conceivably could have been rejected due to a false reading. Thus, the rejected tablets 10 may be fed back into the bin 32 for a subsequent inspection. Typically, however, the rejected tablets 10 will be discarded or reprocessed to produce new tablets without the defects. Tablets 10 without defects are advanced from the conveying station 54 to an egress system 90 for packaging. The egress system may include a pair of pinch belts 92 and 94. The egress pinch belts 92 and 94 may be used for achieving a specified egress speed to accommodate optimum rates for downstream packaging equipment.

The egress pinch belts 92 and 94 also may permit additional or alternative inspection on the linearly moving tablets 10. For example the apparatus 30 can be provided with a top camera 96 disposed above the conveyor belt 56 to optically inspect the top of the tablet 10, and/or a bottom camera 98 facing upwardly between the egress pinch belts 92 and 94 to inspect the bottom of the linearly moving tablets 10. The use of top and bottom cameras 96 and 98 in proximity to the pinch belts 92 and 94 enables inspection to be carried out without using the above described uprighter 45. This may be particularly helpful for tablets having shapes, and particularly side edge shapes, that are not well suited to transportation in an upright orientation. The top and bottom cameras 96 and 98 may be used in conjunction with proposed cameras for inspecting sides of each tablet. Thus, cameras may be disposed to inspect each tablet from four directions separated from one another by approximately 90°.

While the invention has been described with respect to a preferred embodiment, it is apparent that various changes can be made without departing from the scope of the invention as defined by the claims.

I claim:

1. A conveying apparatus for electro-optical inspection of objects, each said object having opposed large dimensioned side surfaces and small dimensioned edge surfaces extending between the side surfaces, said conveying apparatus comprising:

a hopper for storing a plurality of said objects;

a feeder for sequentially feeding objects from said hopper with each said object being stably supported on one of said large dimensioned side surfaces;

an uprighter for sequentially rotating said objects into an upright orientation supported on one of said small dimensioned edge surfaces; and a linear conveyor in proximity to said uprighter for conveying the upright objects linearly from said uprighter, said conveyor including a vacuum source for holding said objects securely in said upright orientation.

2. The apparatus as in claim 1, further comprising first and second cameras disposed on opposite respective sides of said conveyor for optically inspecting the respective first and second side surfaces of each said object held and conveyed in said upright position by said conveyor.

3. The apparatus of claim 2, further comprising an ejector for ejecting objects with defects identified by said cameras.

4. The apparatus of claim 1, wherein the feeder comprises first and second feeders, said first feeder being operative to feed the objects to said second feeder, and said second feeder being operative to feed the objects to the conveyor, said first feeder being operative to feed the objects at a slower rate than the second feeder for preventing jamming of objects in proximity to said conveyor.

5. The apparatus of claim 1, wherein said linear conveyor comprises a pair of oppositely rotatable pinch belts for linearly moving the objects at a specified feed rate.

6. The apparatus of claim 1, wherein the conveyor comprises an air permeable conveyor belt and a vacuum adjacent a portion of said conveyor for holding said objects in the upright orientation.

7. The apparatus of claim 6, wherein said air permeable conveyor belt comprises a perforated metallic strip.

8. The apparatus of claim 6, wherein the air permeable conveyor belt comprises a fabric belt.

9. The apparatus of claim 6, wherein the conveyor further comprises at least one timing belt having a profile selected for supporting said objects in a selected orientation and at a selected spacing.

10. The apparatus of claim 6, wherein the conveyor further comprises at least one pair of opposite rotatable pinch belts for linearly moving the objects at a specified feed rate.

11. The apparatus of claim 10, wherein the pair of oppositely rotatable pinch belts is disposed upstream of said air permeable conveyor belt.

12. The apparatus of claim 11, further comprising a second pair of oppositely rotatable pinch belts downstream of said air permeable conveyor belt.

13. An inspection apparatus for inspecting each of a plurality of objects, said apparatus comprising:

a hopper for storing said plurality of said objects;

a feeder for sequentially feeding objects from said hopper;

a linear conveyor for linearly conveying said objects from said feeder;

a spacing scanner in proximity to said linear conveyor for sensing spacing between adjacent objects on said conveyor;

a blow-off unit downstream from said spacing scanner for removing objects having an elapsed time spacing relative to adjacent objects less than a predetermined minimum elapsed time spacing; and a pair of oppositely directed cameras disposed respectively on opposite sides of said conveyor for optically inspecting opposed sides of each object being linearly conveyed by said conveyor.

14. An apparatus as in claim 13, further comprising an ejector downstream from said cameras, said ejector being operative to eject from said conveyor objects identified by said camera as being defective.

15. An apparatus for inspecting each of a plurality of objects, said apparatus comprising:

a hopper for storing said plurality of said objects;

a feeder for receiving said objects from said hopper and for sequentially feeding said objects received from said hopper;

a linear conveyor for linearly conveying said objects from said feeder, said linear conveyor comprises a pair of oppositely rotatable pinch belts driven about parallel axes; and a pair of oppositely directed cameras disposed respectively on opposite sides of said conveyor for optically inspecting opposed sides of each object being linearly conveyed by said conveyor, at least one said camera being aligned with said pinch belts.

16. An apparatus as in claim 15, wherein said pinch belts are rotatable about parallel axes, and wherein said camera aligned with said pinch belts comprises a first camera aimed substantially parallel to the rotational axes of said pinch belts and aimed at said tablets being transported by said pinch belts, and wherein said apparatus further comprises a second camera aimed substantially parallel to said rotatable axes of said pinch belts, but being directed in an opposite direction relative to said first camera.

17. The apparatus of claim 15, wherein the conveyor comprises an air permeable belt for linearly conveying each said object and a vacuum in proximity to said conveyor for holding each said object on said conveyor at a predetermined orientation.

18. The apparatus of claim 17, further comprising third and fourth oppositely directed cameras aligned substantially orthogonally to said first and second cameras and to said conveyor belt for sequentially inspecting opposite sides of each said object.

19. An apparatus as in claim 15, further comprising an ejector for ejecting from said conveyor selected ones of objects identified by said cameras as being defective.

20. An apparatus as in claim 19, further comprising egress means downstream from said ejector for moving objects without defects.

21. An apparatus as in claim 15, wherein said pair of oppositely rotatable pinch belts defines a first pair of oppositely rotatable pinch belts, and wherein said conveyor further comprises a second pair of oppositely rotatable pinch belts downstream from said first pair of oppositely rotatable pinch belts.

22. An apparatus as in claim 15, wherein said feeder comprises a centrifugal feeder.

23. An apparatus for inspecting each of a plurality of objects, said apparatus comprising:

a hopper for storing said plurality of said objects;

a feeder for receiving said objects from said hopper and for sequentially feeding said objects received from said hopper;

a fixed guide in proximity to said feeder for rotationally orienting each said object being fed by said feeder into a selected orientation for viewing;

a linear conveyor for linearly conveying said rotationally oriented objects from said feeder; and a pair of oppositely directed cameras disposed respectively on opposite sides of said conveyor for optically inspecting opposed sides of each said rotationally oriented object being linearly conveyed by said conveyor.

* * * * *